US010930446B1

(12) United States Patent
Eberts et al.

(10) Patent No.: US 10,930,446 B1
(45) Date of Patent: Feb. 23, 2021

(54) CIRCUIT BREAKERS WITH GAS-BLOCKING MEMBERS AND RELATED METHODS

(71) Applicant: Eaton Intelligent Power Limited, Dublin (IE)

(72) Inventors: William Eberts, Moon Township, PA (US); Thomas Ted Kuzniarski, Moon Township, PA (US); Mark Janusek, Bethel Park, PA (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/799,997

(22) Filed: Feb. 25, 2020

Related U.S. Application Data

(60) Provisional application No. 62/942,500, filed on Dec. 2, 2019.

(51) Int. Cl.
*H01H 9/02* (2006.01)
*H01H 9/34* (2006.01)
*H01H 9/48* (2006.01)

(52) U.S. Cl.
CPC ..... *H01H 9/34* (2013.01); *H01H 9/02* (2013.01); *H01H 9/48* (2013.01)

(58) Field of Classification Search
CPC .. H01H 9/34; H01H 9/02; H01H 9/48; H01H 9/047; H01H 71/0207; H01H 71/08; H01H 71/325; H01H 2071/088; H02B 1/26
USPC ..... 200/303, 293, 306, 305, 304; 218/155, 218/157, 139
See application file for complete search history.

(56) References Cited

U.S. PATENT DOCUMENTS 2,727,965 A * 12/1955 Toth ..... H01H 9/0264 200/304
4,631,376 A * 12/1986 Leone ..... H01H 9/342 200/306
4,650,940 A * 3/1987 Grunert ..... H01H 9/342 218/155
5,241,289 A * 8/1993 Markowski ..... H01H 9/342 335/201
5,304,761 A * 4/1994 Rosen ..... H01H 9/0264 200/304
5,811,749 A * 9/1998 Bausch ..... H01H 9/342 200/306
6,144,001 A * 11/2000 Green ..... H01H 9/0264 200/304
6,407,354 B1 * 6/2002 Turner ..... H01H 9/342 218/155
6,512,192 B1 * 1/2003 Yee ..... H01H 9/342 218/157
7,009,126 B2 * 3/2006 Etscheidt ..... H01H 9/0264 200/293
8,222,983 B2 7/2012 Zhou et al.

* cited by examiner

*Primary Examiner* — William A Bolton
(74) *Attorney, Agent, or Firm* — Myers Bigel, P.A.

(57) ABSTRACT

Circuit breakers having a cover that includes a medial segment with an aperture for a switch handle. The medial segment merges into a line side segment having at least one channel overlying a lug compartment. The at least one channel has an inner end portion overlying a lug access path to the lug compartment. The circuit breakers also include at least one gas-blocking member coupled to the at least one channel.

23 Claims, 12 Drawing Sheets

CIRCUIT BREAKERS WITH GAS-BLOCKING MEMBERS AND RELATED METHODS

RELATED APPLICATIONS

This application claims the benefit of and priority to U.S. Provisional Patent Application Ser. No. 62/942,500, filed Dec. 2, 2019, the contents of which are hereby incorporated by reference as if recited in full herein.

FIELD OF THE INVENTION

The present invention relates to circuit breakers.

BACKGROUND OF THE INVENTION

Circuit breakers are one of a variety of overcurrent protection devices used for circuit protection and isolation. The circuit breaker provides electrical protection whenever an electric abnormality occurs. In a circuit breaker, current enters the system from a power line and passes through a line conductor to a stationary contact fixed on the line conductor, then to a movable contact. The movable contact can be fixedly attached to a rotatable arm. As long as the stationary and movable contacts are in physical contact, current passes from the stationary contact to the movable contact and out of the circuit breaker to down line electrical devices.

In the event of an overcurrent condition (e.g., a short circuit), extremely high electromagnetic forces can be generated. The electromagnetic forces repel the movable contact away from the stationary contact. Because the movable contact is fixedly attached to a rotating arm, the arm pivots and physically separates the stationary and movable contacts thus tripping the circuit. Upon separation of the contacts and blowing open the circuit, an arcing condition occurs. The breaker's trip unit will trip the breaker which will cause the contacts to separate. Also, arcing occurs during normal "ON/OFF" operations on the breaker.

As shown by the prior art cover of a circuit breaker in FIG. 1, the cover typically has circular (lug) access holes to allow an access path to tighten cable lugs. During certain short circuit or other fault interruptions, relatively short blasts of hot gases can be generated and can be expelled out of the holes above the lugs. Some of these expelled hot gases can travel toward a steel cover placed over the circuit breaker which can short out to the breaker enclosure.

In the past, a fish paper barrier has been used to mitigate this issue. Also, in the past, a plastic over-cover/molded barrier has been screwed on top of the circuit breaker over the access holes to reside between the steel plate and the circuit breaker cover. There remains a need for alternative designs to reduce or block interruption gases exiting the lug access holes.

SUMMARY OF EMBODIMENTS OF THE INVENTION

Embodiments of the present invention are directed to circuit breakers with covers that couple to members that cover lug access holes.

Embodiments of the present invention are directed to molded-case circuit breakers with a plurality of molded channels in a line side segment of a front cover.

Embodiments of the present invention are directed to circuit breakers that include a cover having a medial segment with an aperture for a switch handle. The medial segment merges into a line side segment comprising at least one channel. The at least one channel has an inner end portion overlying a lug access path. The circuit breakers also include at least one gas-blocking member coupled to the at least one channel.

The at least one channel can have an internal end that can include an arcuate perimeter surrounding an open space overlying the lug access path.

The at least one channel can include a floor with an internal end that can be arcuate and that can reside in a plane that is beneath the internal end of the at least one channel, with the cover held in a horizontal orientation with the aperture for the switch handle facing upward.

The circuit breaker can include at least first and second poles. The cover can have first and second channels as the at least one channel. The at least one gas-blocking member can be provided as a first gas-blocking member and a second gas-blocking member. The first and second gas-blocking members can be independently moveable while coupled to a corresponding first or second elongate channel.

The at least one gas-blocking member can be elongate with a rigid or semi-rigid three-dimensional body.

The at least one channel can have an externally facing top that is open and flush with or recessed with an outer surface the line side segment.

The at least one channel can have a lateral extent and a longitudinal extent with a laterally and longitudinally extending gap space between opposing sides of a respective channel to define the externally facing top that is open.

The at least one channel can have a floor that is closed and terminates adjacent but spaced apart from an inner end of the at least one channel.

The inner end of the at least one channel can be arcuate. The floor can have an inner end that is arcuate. When viewed from a top with the cover in a horizontal orientation with the aperture for the switch handle facing upward, the floor can reside in a plane that is beneath a plane providing the inner end of the at least one channel. The inner end of the at least one channel and the inner end of the floor define a circle about the lug access path, also when viewed from a top with the cover in a horizontal orientation with the aperture for the switch handle facing upward.

The at least one channel can have an outer facing end residing at an outer lower perimeter of the cover, with the line side segment of the cover facing down. The outer facing end can be rectangular with a bottom long side thereof residing under or flush with an outer surface of the line side segment of the cover, with the line side segment of the cover facing down.

The at least one channel can have laterally spaced apart sidewalls residing above a rectangular compartment and above lugs coupled to the circuit breaker. The sidewalls can have laterally inwardly projecting tabs to thereby facilitate retention of the at least one gas-blocking member in the at least one channel if a circuit breaker is turned upside down.

The at least one gas-blocking member can have a bottom that is planar. The gas-blocking member can have a top portion that extends above the bottom and that has a lateral extent over at least major portion of a length thereof that is less than a lateral extent of the bottom.

The top portion of the at least one gas-blocking member can have an inner end that is curvilinear. The bottom can have an inner end that resides a distance forward of the inner end of the top portion.

The at least one gas-blocking member can have a notch in a leading top end portion thereof configured to engage a screw driver tip to thereby allow a user to dislodge the at least one gas-blocking member for access to the lug access path.

One of the at least one gas-blocking member can be slidably coupled to one of the at least one elongate channels.

One of the at least one gas-blocking member can be pivotably coupled to one of the at least one elongate channels.

The at least one gas-blocking member can have a length dimension that is greater than a width dimension.

Other embodiments are directed to covers for a circuit breaker. The covers include a cover member with a medial segment with an aperture for a switch handle. The medial segment merges into a line side segment comprising at least one channel. The at least one channel includes an inner end portion overlying a lug access path. The at least one channel has an externally facing top that is open and flush with or recessed with an outer surface the line side segment.

With the line side segment of the cover member facing down, the at least one channel can have an outer facing end residing at an outer lower perimeter of the cover member. The outer facing end is rectangular with a bottom long side thereof residing under or flush with an outer surface of the line side segment of the cover member.

Yet other embodiments are directed to methods of blocking gas flow in a circuit breaker. The methods include providing a circuit breaker with a cover having at least one channel that resides on a line side segment of the cover, the at least one channel including an open segment that resides over a lug access path. The methods include moving a gas-blocking member coupled to the at least one channel to a first position to reveal the lug access path while the gas-blocking member remains coupled to the at least one channel. The gas-blocking member is a rigid or semi-rigid member. The methods also include moving the gas-blocking member to a second position to occlude the lug access path with the gas-blocking member coupled to the at least one channel to thereby block hot gases generated during a circuit interruption event from traveling outwardly therefrom.

The methods can optionally further include one or more of (a)-(c).

Optionally (a), the at least one channel comprises at least first and second channels, wherein the gas-blocking member is provided as at least first and second separate gas-blocking members, the first gas-blocking member coupled to the first channel and the second gas-blocking member coupled to the second channel, the method further comprising independently moving the first gas-blocking member to the first position while coupled to the first channel and while the second gas-blocking member remains in the second position in the second channel.

Optionally (b), the at least one channel has an externally facing top that is open and flush with or recessed with an outer surface the line side segment.

Optionally (c), the moving steps are carried out by sliding the gas-blocking member in the at least one channel.

Further features, advantages and details of the present invention will be appreciated by those of ordinary skill in the art from a reading of the figures and the detailed description of the preferred embodiments that follow, such description being merely illustrative of the present invention.

It is noted that aspects of the invention described with respect to one embodiment, may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

DETAILED DESCRIPTION OF EMBODIMENTS OF THE INVENTION

Figure 1:
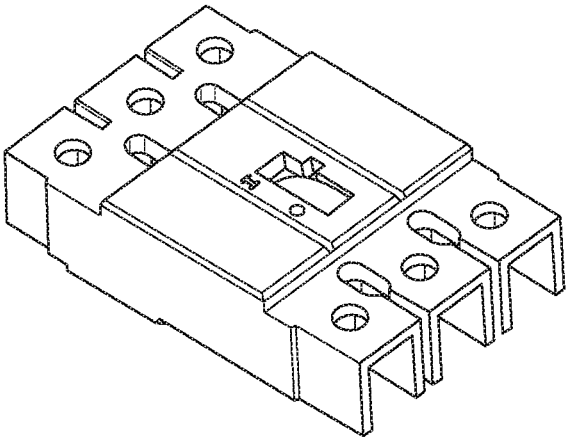
FIG. 1 PRIOR ART
FIG. 1 is a side perspective view of a prior art cover of a circuit breaker.

The present invention now will be described more fully hereinafter with reference to the accompanying drawings, in which illustrative embodiments of the invention are shown. Like numbers refer to like elements and different embodiments of like elements can be designated using a different number of superscript indicator apostrophes (e.g., 10, 10', 10"). The terms "FIG." and "FIG." may be used interchangeably with the word "Figure" as abbreviations thereof in the specification and drawings.

It will be understood that when an element is referred to as being on or attached to another element, it can be directly on or attached to the other element or intervening elements may also be present. In contrast, when an element is referred to as being "directly on" or "directly attached to" another element, there are no intervening elements present. Similarly, when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between", "adjacent" versus "directly adjacent", etc.).

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90° or at other orientations) and the spatially relative descriptors used herein interpreted accordingly.

The term "about" refers to numbers in a range of +/−20% of the noted value.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and the relevant art and will not be interpreted in an idealized or overly formal sense unless expressly so defined herein.

Figure 6:
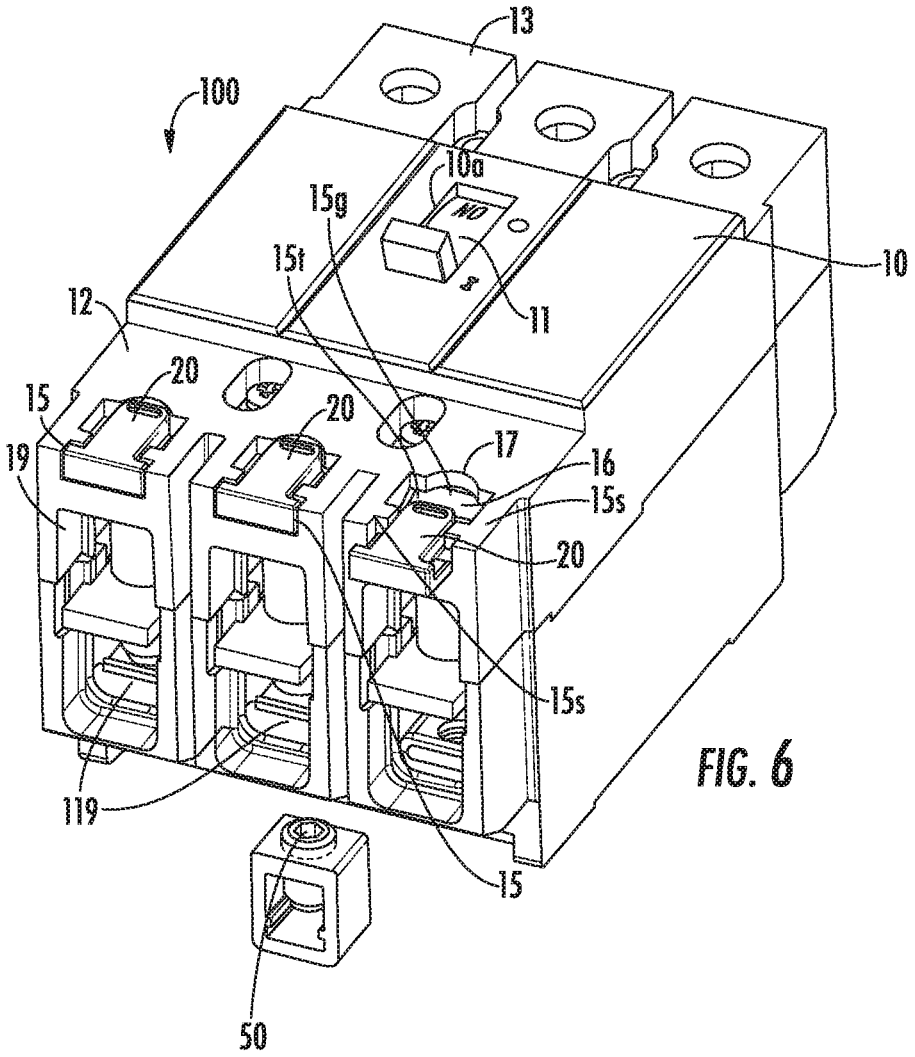
FIG. 6 is a line side, end perspective view of a circuit breaker with the cover and gas-blocking members shown in FIG. 2.
Figure 7:
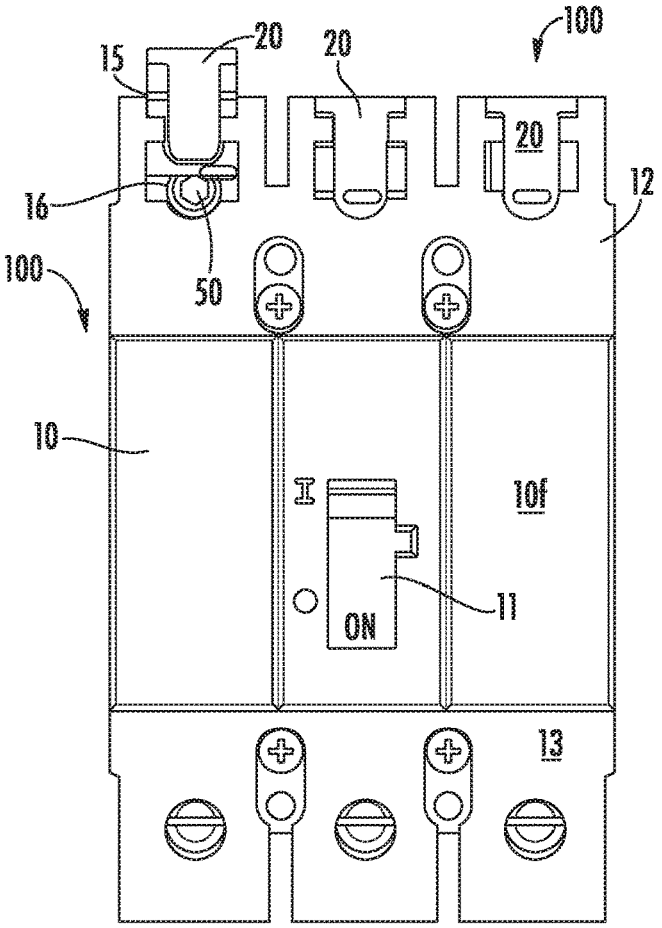
FIG. 7 is top view of the circuit breaker shown in FIG. 6.
Figure 8:
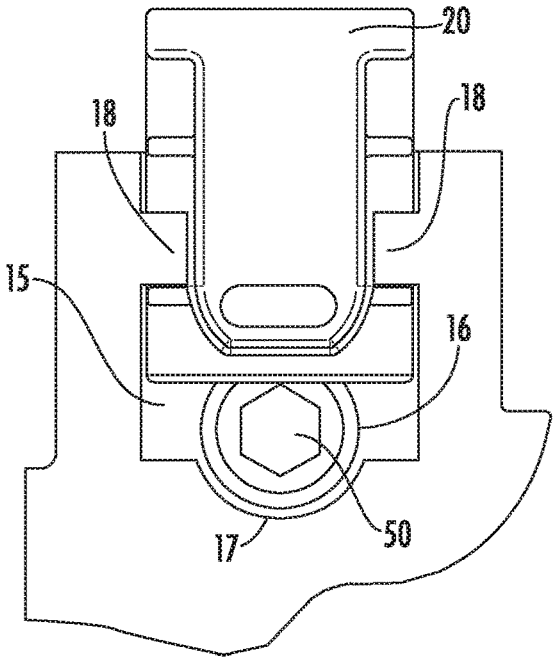
FIG. 8 is a greatly enlarged view of one segment of the circuit breaker shown in FIGS. 6 and 7 according to embodiments of the present invention.

Turning now to the figures, FIGS. 2-5 illustrate an example cover 10 for a circuit breaker 100 (FIGS. 6-8). The cover 10 comprises a cover member body 10*b* with a front surface 10*f* with an aperture 10*a* about a switch handle 11 (FIG. 6) providing On/Off states. The cover 10 has a line side segment 12 and a load side segment 13. A medial portion 10*m* of the front 10*f* of the cover 10 can reside in a plane that is above (with the cover in a horizontal orientation) or in front of (with the cover in a vertical orientation) of an outer surface 12*t* of the line side segment 12.

Figure 2:
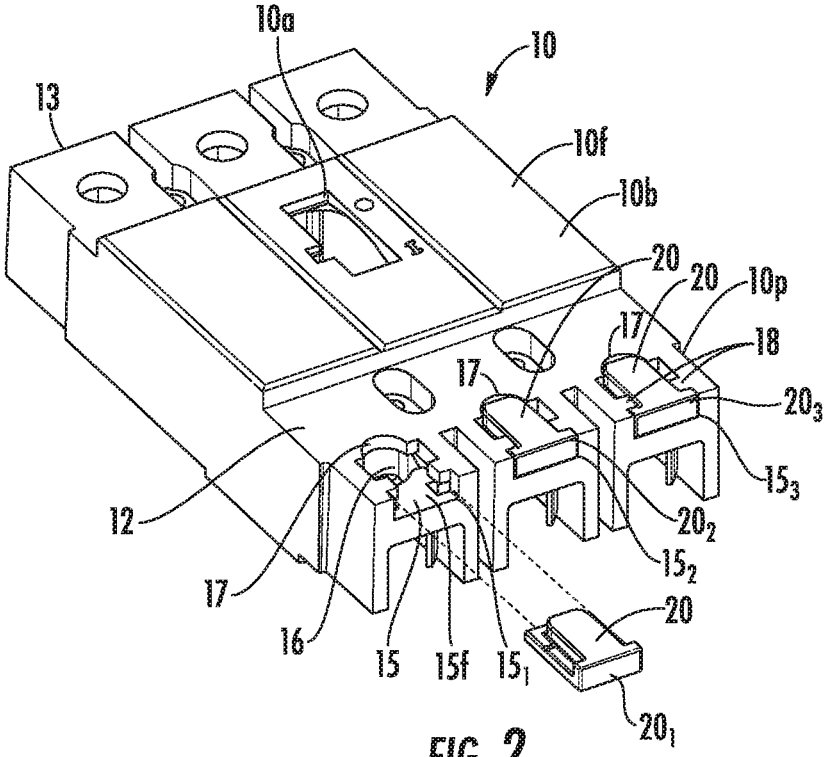
FIG. 2 is side perspective, partially exploded, view of a cover with gas-blocking members according to embodiments of the present invention.
Figure 3:
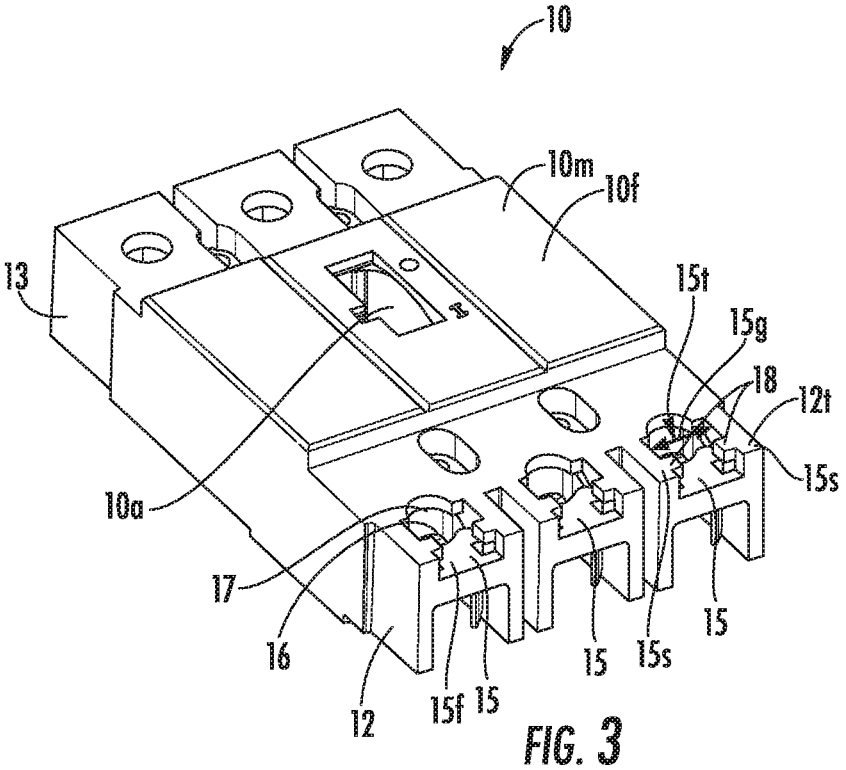
FIG. 3 is a side perspective view of the cover shown in FIG. 2 sans the gas-blocking members.
Figure 5:
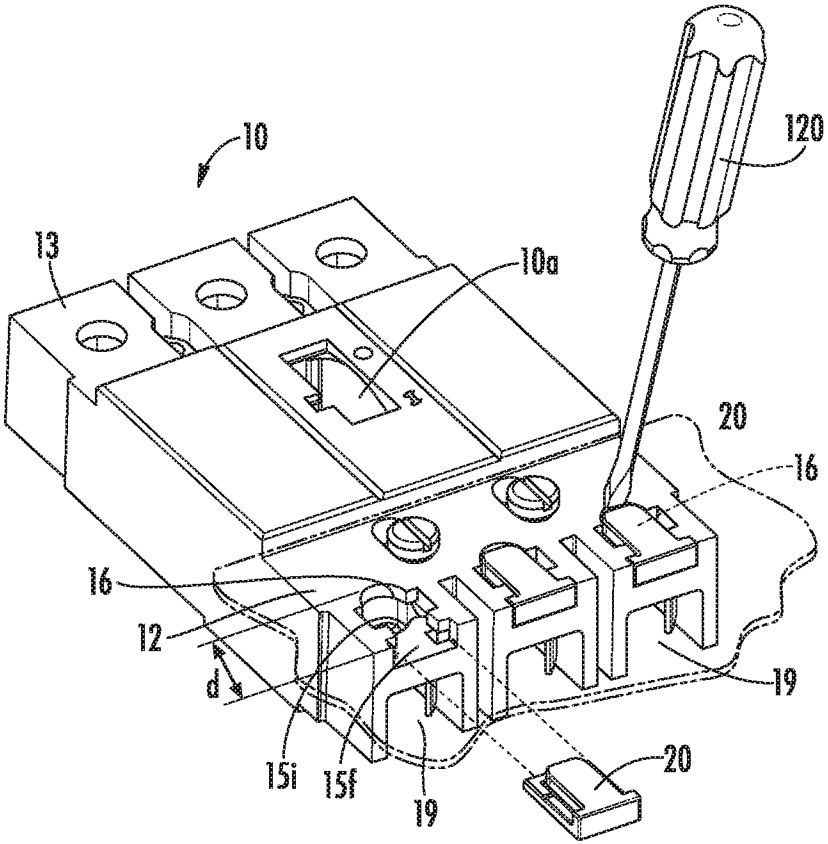
FIG. 5 is a side perspective view of the cover and gas-blocking members shown in FIG. 2.
Figure 4:
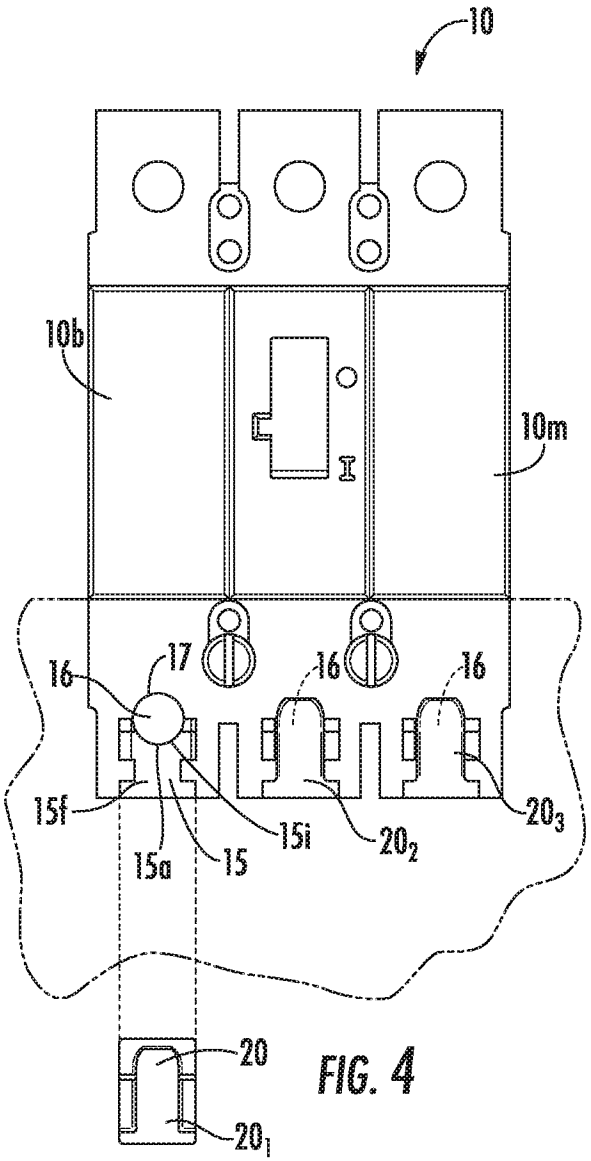
FIG. 4 is top view of the cover and gas-blocking members shown in FIG. 2.

As shown, the line side segment 12 comprises a plurality of parallel channels 15 that can reside in a plane that is coplanar with the medial portion 10*m* of the front surface 10*f* of the cover 10 and/or outer surface 12*t* of the line side segment 12. The channels 15 have a segment that defines an internal (lug) access path 16 to a lug compartment 119 comprising a lug screw 50 (FIGS. 6-8). A gas blocking member 20 couples to at least one channel 15 in the line side segment 12 of the cover 10 and physically covers and/or blocks gas from exiting the lug access path 16 when the gas blocking member 20 is in a fully assembled position in a respective channel 15, as shown in FIG. 2 with gas blocking members $\mathbf{20}_2$, $\mathbf{20}_3$.

The gas-blocking member(s) 20 can have a rigid or semi-rigid body with a three-dimensional shape. The term "semi-rigid" means that the gas-blocking member 20 has sufficient rigidity to retain its three-dimensional shape but can flex under load.

The cover 10 is shown for a three pole configuration with three separate channels $\mathbf{15}_1$, $\mathbf{15}_2$, $\mathbf{15}_3$, and three corresponding gas-blocking members $\mathbf{20}_1$, $\mathbf{20}_2$, $\mathbf{20}_3$, but single and two pole configurations may be provided.

In some embodiments, each gas-blocking member $\mathbf{20}_1$, $\mathbf{20}_2$, $\mathbf{20}_3$ can be independently moveable relative to each other.

In some embodiments, the gas-blocking members 20 can be coupled to each other so that if one is moved, the others are also moved to an open and/or closed position in respective channels 15.

The gas blocking member 20 is not required to seal the underlying compartment/space 19 but can reduce, if not eliminate, hot gases generated from a circuit interruption from escaping or being ejected out of the cover 10 from the lug access path 17.

Referring to FIGS. 2-5 and 9A, 9B and 10, the channels 15 can be flush or recessed channels that hold a respective gas blocking member 20 flush with or beneath an outer surface 12*t* of the line side segment 12 of the cover 10. This configuration does not add to the outside/external footprint of the breaker 100 (FIG. 6-8) and may be particularly advantageous for certain installations.

Figure 9A:
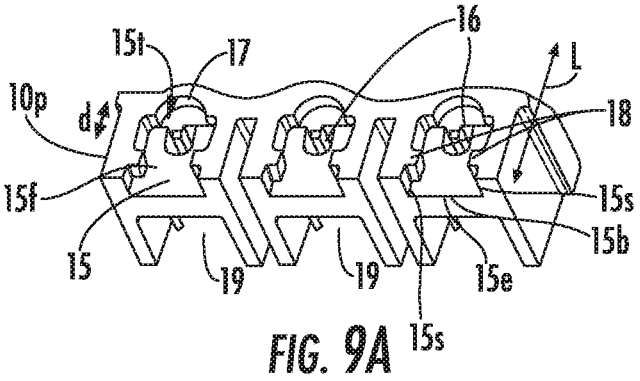
FIG. 9A is a line side perspective view of a portion of the cover shown in FIG. 2 illustrating a plurality of parallel channels.
Figure 9B:
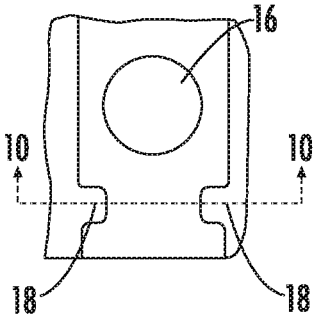
FIG. 9B is an enlarged view of a single one of the channels of the cover shown in FIG. 9A according to embodiments of the present invention.
Figure 10:
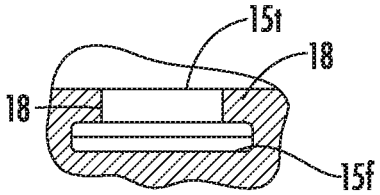
FIG. 10 is a section view taken along line 10-10 in FIG. 9B according to embodiments of the present invention.

Referring to FIG. 9A, the channels 15 can have an outer facing (line side) end 15*e* that has a bottom 15*b*, and opposing sidewalls 15*s* spaced apart across a top 15*t*. The top 15*t* can be open to define an open outer facing gap space 15*g*. The bottom 15*b* is shown as having a closed surface defining a closed floor surface 15*f* along a sub-set of a length dimension L. However, in other embodiments, the bottom 15*b* can be at least partially open along the entire length dimension L over the rectangular compartment 19 and the gas blocking member 20 can be coupled to the channel 15 to provide gas blocking capacity along the entire length dimension (not shown).

The channels 15 can have an outer facing end 15*e* that resides at an outer lower perimeter 10*p* of the cover 10 (with the line side segment 12 of the cover 10 facing down). The outer facing end 15*e* can be rectangular with a bottom 15*b* being a long side and residing under or flush with an outer surface 12*t* of the line side segment 12 of the cover 10.

In some embodiments, the channels 15 have a floor 15*f* that resides under (with the cover in a horizontal orientation) or behind (with the cover in the vertical orientation) the outer surface 12*t* of the line side segment 12.

The channels 15 can be elongate channels. The channels 15 can have a closed floor surface 15*f* above a rectangular compartment 19. The closed floor surface 15*f* can have an internal end 15*i*. The internal end 15*i* of the closed floor surface 15*f* can be spaced apart from and face an internal end 17 of the channel 15. The internal end 15*i* of the closed floor surface 15*f* can be arcuate 15*a* and/or semi-circular. The internal end of the channel 15 can be arcuate and/or semi-circular. Thus, the internal end 15*i* of the closed floor surface 15*f* and the internal end 17 of the channel 15 can define a circular opening above/in front of the access path 16 when viewed from a front or top (shown as from a front in FIG. 4 with the cover oriented as shown). The internal end 17 of the channel 15 can be coplanar and above (with the cover 10 in a horizontal orientation with the handle 11 facing up) or in front of (with the cover 10 in a vertical orientation) with the handle facing forward) a plane providing the floor 15*f*.

For installation or service, a user can move the gas-blocking member 20 to reveal the access path 16 thereunder, while the gas blocking member 20 remains coupled to a corresponding channel 15, and tighten a lug screw such as by inserting a screw driver 120 (FIG. 5) into an access path 16. This allows a user to be able to access the underlying lug screw 50 (FIG. 8). A user can return the gas-blocking member 20 to the fully closed state in the channel 15 when access is not needed and/or for normal operation.

The internal end 17 of the channel 15 can reside above the closed floor surface 15*f*. In some embodiments, the innermost surface of the internal end 17 of the channel can reside a distance "d" (FIGS. 5, 9A) above or outward from the closed floor surface 15*f* in a range of about 0.100 inches to about 0.25 inches.

The channels 15 can comprise retention tabs 18 that project inwardly from opposing sides of a respective channel 15. Where used, the retention tabs 18 can reside directly opposing each other as shown or may be spaced to be offset (not shown).

Figure 11:
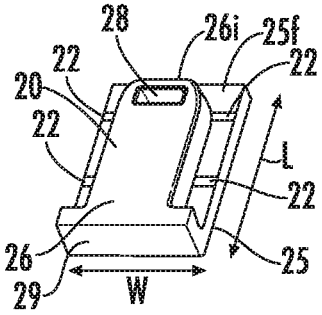
FIG. 11 is an enlarged view of an example gas-blocking member shown in FIG. 2.
Figure 12:
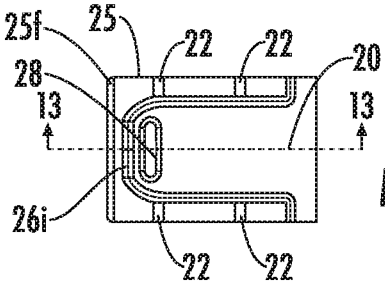
FIG. 12 is a top view of the gas-blocking member shown in FIG. 11.
Figure 13:
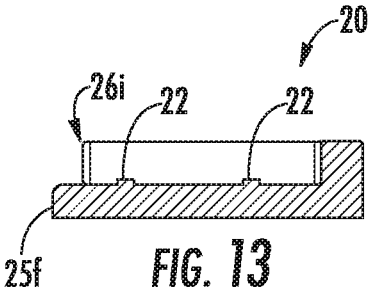
FIG. 13 is a section view of the gas-blocking member taken along line 13-13 in FIG. 12.

Referring to FIGS. 11-13, the gas-blocking member 20 can be elongate. The gas-blocking member 20 can comprise a plurality of spaced apart raised ribs or bumps 22, shown as laterally extending ribs that are longitudinally spaced apart over a length direction of the gas-blocking members 20. The raised ribs or bumps 22 can cause the gas-blocking member to frictionally engage the channel 15 so that once assembled, the gas-blocking members 20 can retain position if a circuit breaker 100 is turned upside down, for example. The raised ribs or bumps 22 can alternatively or additionally be placed on a bottom surface 25 of the gas blocking members (not shown).

In some embodiments, the gas-blocking member 20 can slidably couple to a channel 15. In some embodiments, the gas-blocking member 20 can pivotably couple to a channels 15 as will be discussed below with respect to FIGS. 15A, 15B, 16A, 16B.

Still referring to FIGS. 11-13, in some embodiments, the gas-blocking member 20 can comprise a bottom 25 that is planar and rectangular. The bottom 25 can have a greater length "L" and width "W" (and surface area) than a top portion 26 of the gas-blocking member 20. The gas-blocking member 20 can have a greater length L than width W over at least a portion of its length. The length L can be in a range of 0.5 inches to about 1 inch. The width W can be in a range of 0.3 to 0.7 inches, typically about 0.5 inches.

The gas-blocking member 20 can have a bottom 25 that is planar. The top portion 26 can extend above the bottom 25 and can have a lateral extent (in a width W dimension) over at least a major portion (50% or more) of the length L that is less than a lateral extent of the bottom 25.

The top portion 26 of the gas-blocking member 20 can have a leading, inner facing, end 26*i* that is curvilinear and can have a width that is less than a width of the front end 25*f* of the bottom 25. The leading end 26*i* can terminate a distance rear of a front end 25*f* of the bottom 25. The leading end 26*i* can have a width W that is in a range of 10-50% less than the width W of the front end 25 of the bottom 25. The top portion 26 can include a notch 28 that can facilitate a user's ability to move the gas-blocking member to access the access path 16.

The gas blocking member 20 can have a back 29 that is rectangular with pairs of long and short sides with the short sides defining a height dimension and the long sides extending over the width dimension. The back 29 extends from the bottom 25 to the top portion 26 of the gas blocking member 20.

In a closed position, as shown in FIG. 7, for example, the leading end 26*i* of the gas-blocking member resides adjacent the curved end 17 of the channel 15 while the bottom of the gas-blocking member is under the curved end 17 of the channel and over the access path 16.

Figure 14A:
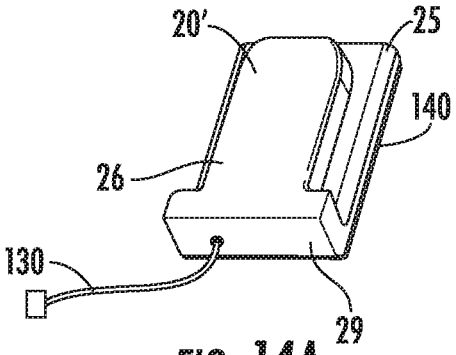
FIG. 14A is a top, side perspective view of another embodiment of a gas-blocking member according to embodiments of the present invention.
Figure 14B:
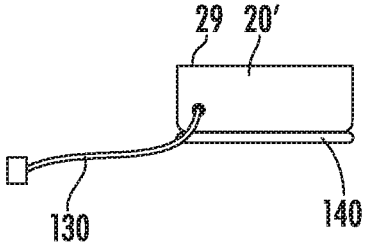
FIG. 14B is an end view of the gas-blocking member shown in FIG. 14A.

Turning now to FIGS. 14A and 14B, in some embodiments, the gas-blocking member 20' can comprise a tether 130 that can be used to attach to the gas-blocking member 20' to a particular channel 15 and/or the cover 10.

As also shown in FIGS. 14A and 14B, the gas-blocking member 20' may comprise a seal 140 that can be placed on the bottom 25. The seal 140 can comprise an O-ring, gasket or other sealant material.

Figure 15A:
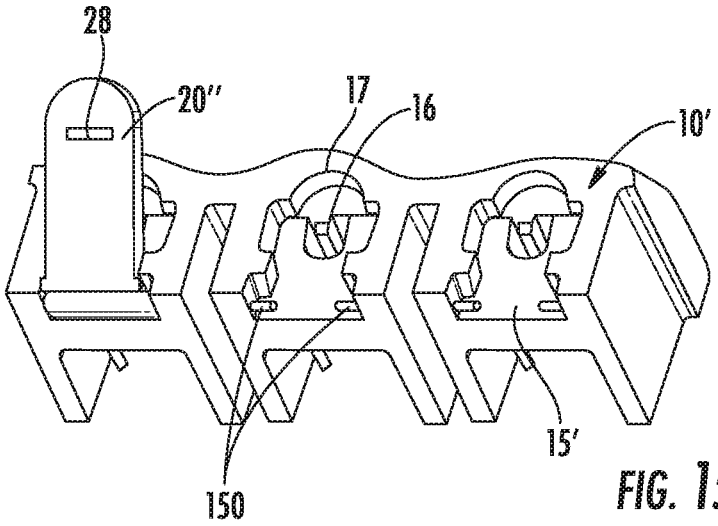
FIG. 15A is a line side perspective view of a portion of the cover illustrating a plurality of parallel channels and an alternate embodiment of the gas-blocking members according to embodiments of the present invention.
Figure 15B:
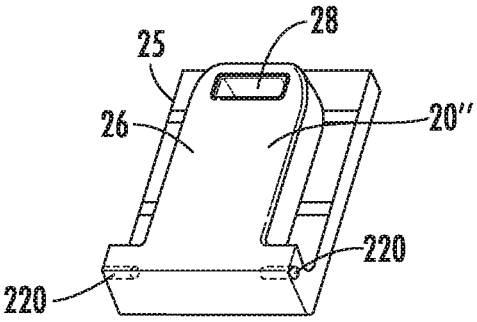
FIG. 15B is a top perspective view of the gas-blocking member shown in FIG. 15A.
Figure 16A:
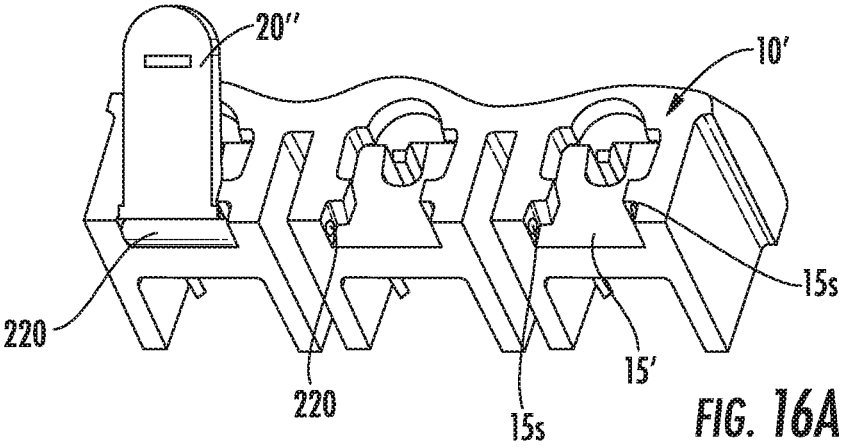
FIG. 16A is a line side perspective view of a portion of the cover illustrating a plurality of parallel channels and an alternate embodiment of the gas-blocking members according to embodiments of the present invention.
Figure 16B:
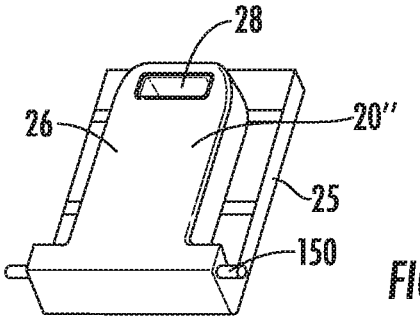
FIG. 16B is a top perspective view of the gas-blocking member shown in FIG. 16A.

Turning to FIGS. 15A, 15B, 16A and 16B, the gas-blocking members 20" can be configured to pivotably couple to respective channels 15'. As shown in FIGS. 15A and 15B, the gas-blocking member 20" can comprise a hinge channel 220 that couples to hinge arms 150 provided by the channels 15 in the cover 10. The hinge arms 150 can project inwardly from an end portion of the channel(s) 15. FIGS. 16A and 16B illustrate that the gas-blocking member 20" can comprise the hinge arm(s) 150, e.g., a single arm or pin that extends across a width dimension of the gas-blocking member 20" or spaced apart laterally extending hinge arms 150 that couple to hinge channels 220 in sidewall 15*s* of the channels 15. The gas-blocking member 20'" can be configured to frictionally lock against a sidewall 15*s* in a closed position.

Figure 17A:
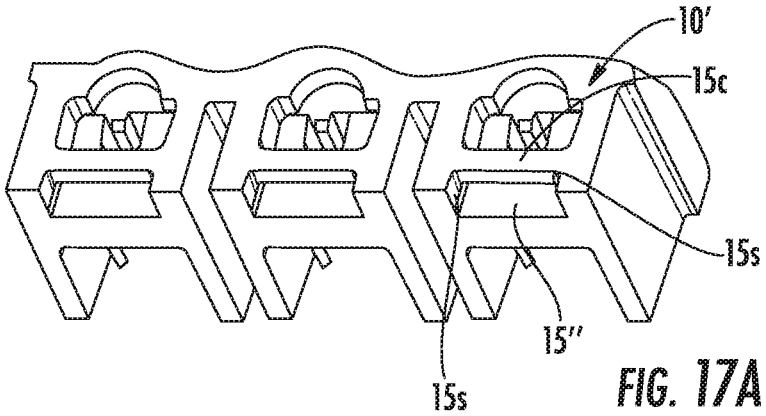
FIG. 17A is a line side perspective view of a portion of the cover illustrating a plurality of parallel channels and an alternate embodiment of the gas-blocking members according to embodiments of the present invention.
Figure 17B:
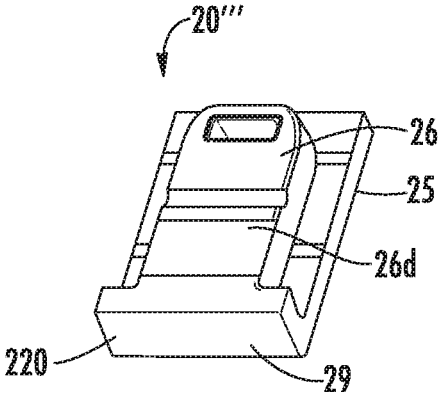
FIG. 17B is a top perspective view of the gas-blocking member that can couple to a respective channel shown in FIG. 17A.

FIG. 17A illustrates that the cover 10" can be configured to provide an open facing gap between pairs of the sidewalls 15*s* forming an open surface of respective channels 15. In some embodiments, the top 15*t* of the channel 15 can have a segment 15*c* that is closed and spans laterally across the channels 15, coupled to opposing sidewalls 15*s*. The segment 15*c* of the top 15*t* that is closed can extend longitudinally a sub-set of a length dimension of the channel 15 and can terminate before the leading end 15*i* of the closed surface of the floor 15*f*. The gas-blocking member 20 can have a top portion 26 that is stepped down at a region that resides under the closed segment 15*c*. The closed segment 15*c* can be provided by a laterally extending pivoting arm 15*a* that pivots up for assembly and movement and pivots down and locks for the fully assembled/closed position. The leading end 26*i* and the back 29 of the gas-blocking member 20'" can have a greater height than the stepped down portion 26*d* that resides under the segment 15*c* when fully assembled/in the closed position.

Figure 18A:
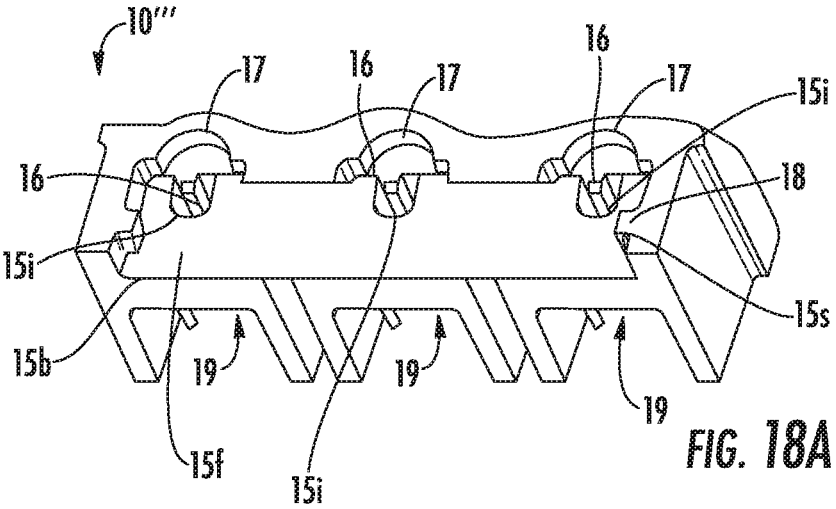
FIG. 18A is a line side perspective view of a portion of the cover illustrating a plurality of an alternate embodiment of the channels and gas-blocking member according to embodiments of the present invention.
Figure 18B:
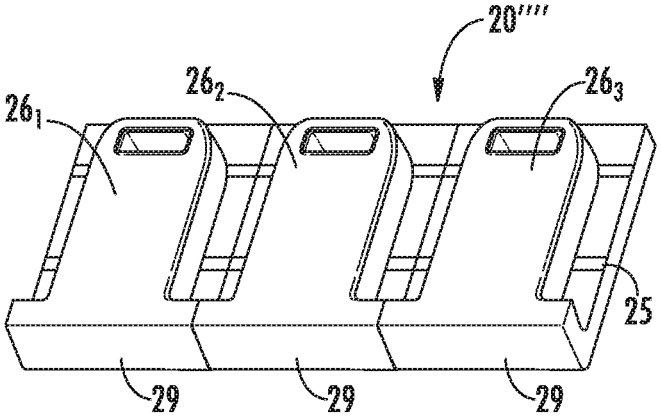
FIG. 18B is a top perspective view of the gas-blocking member that can couple to the channel shown in FIG. 18A.

FIG. 18A illustrates another example of a cover 10' with a cover member comprising a channel 15. In this embodiment, the channel 15 can be configured to couple to a unitary/single gas-blocking member 20"" (FIG. 18B). The unitary gas blocking member 20"" can comprise a plurality of top portions $\mathbf{26}_3$, $\mathbf{26}_2$, $\mathbf{26}_3$ held above the bottom 25 and can span across a plurality of poles of the circuit breaker (two poles or three poles for a two pole or three pole breaker) which can provide a corresponding plurality of spaced apart lug access paths 16 based on cooperating shaped segments of the channel 17 and the channel 15. The channel 15 can have a floor 15*b* that extends across two compartments 19 (for a two pole breaker) or three compartments 19 (for a three pole breaker) and over lug compartments holding lugs 50 (FIG. 6) and can have a plurality of laterally spaced apart shaped internal ends 15*i* defined by parts of the floor 15*f* aperture.

By way of example only, the cover 10, 10', 10", 10' can comprise thermoset glass polyester. The gas-blocking member 20, 20', 20", 20'", 20' can comprise a non-flammable material such as nylon or a glass-filled nylon optionally 10-20% glass filled nylon.

The circuit breaker 100 can be a molded case circuit breaker (MCCB).

In some particular embodiments, the circuit breaker 10 can be a bi-directional direct current (DC) molded case circuit breaker (MCCB). See, e.g., U.S. Pat. No. 8,222,983, the contents of which are hereby incorporated by reference as if recited in full herein. The DC MCCBs can be suitable for many uses such as data center, photovoltaic and electric vehicles applications. The circuit breakers 10 can be rated for voltages between about 1 V to about 5000 volts (V) DC and/or may have current ratings from about 15 to about 2,500 Amperes (A). However, it is contemplated that the circuit breakers 10 and components thereof can be used for any voltage, current ranges and are not limited to any particular application as the circuit breakers can be used for a broad range of different uses.

In some embodiments, the circuit breakers 10 can be suitable as AC circuit breakers or both AC and DC circuit breakers.

As is known to those of skill in the art, Eaton Corp. has introduced a line of molded case circuit breakers (MCCBs) designed for commercial and utility scale photovoltaic (PV) systems. Used in solar combiner and inverter applications, Eaton PVGard™ circuit breakers are rated up to 600 amp at 1000 Vdc and can meet or exceed industry standards such as UL 489B, which requires rigorous testing to verify circuit protection that meets the specific requirements of PV systems. However, it is contemplated that the circuit breakers 10 can be used for various applications with corresponding voltage capacity/rating.

Figure 19:
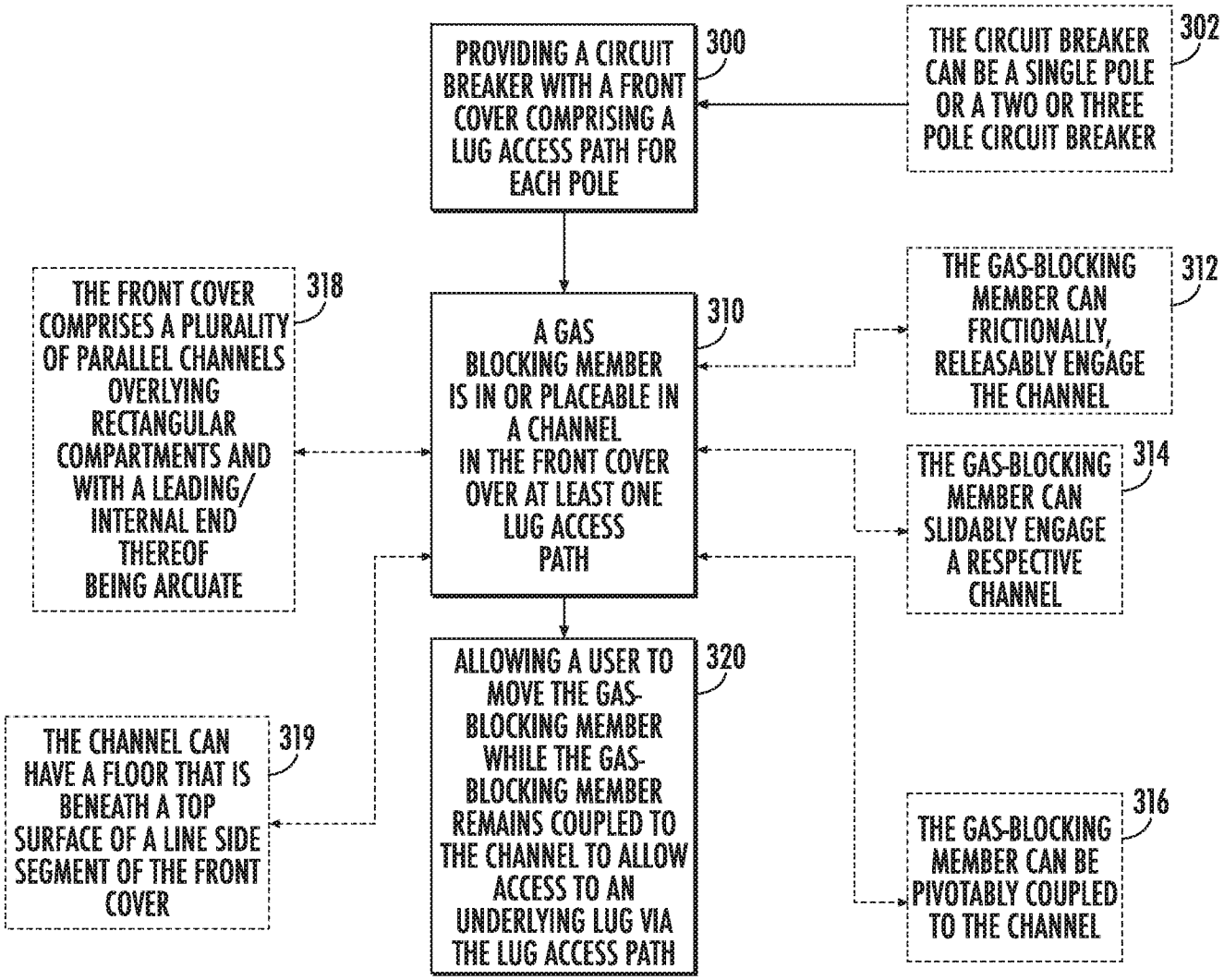
FIG. 19 is an example flow chart of a method of blocking gas flow in a circuit breaker according to embodiments of the present invention.

FIG. 19 illustrates actions that can be carried out to block gas flow according to embodiments of the invention.

A circuit breaker with a front cover comprising a lug access path for each pole is provided (block 300). A gas blocking member is in or is placeable into a channel in the front cover over a respective lug access path (block 310). A user is allowed/user input is accepted to move the gas-blocking member while the gas-blocking member remains coupled to the channel to allow access to an underlying lug via the lug access path (block 320).

The circuit breaker can be a single pole or a two or three pole circuit breaker (block 302).

The gas blocking member can frictionally, releasably engage the channel (block 312).

The gas-blocking member can slidably engage a respective channel (block 314).

The gas-blocking member can be pivotably coupled to the channel (block 316).

The front cover can comprise a plurality of parallel channels overlying rectangular compartments and with a leading/internal end thereof being arcuate (block 318).

The channel(s) can have a floor that is beneath a top surface of a line side segment of the front cover (block 319).

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed is:

1. A circuit breaker, comprising:

a cover comprising a medial segment with an aperture for a switch handle, wherein the medial segment merges into a line side segment comprising at least one channel that is in a plane that is parallel to an outer surface of the medial segment, wherein the at least one channel comprises an inner end portion overlying a lug access path; and at least one gas-blocking member coupled to the at least one channel and held in an orientation that is parallel to the outer surface of the medial segment.

2. The circuit breaker of claim 1, wherein the inner end portion has an arcuate perimeter that is adjacent an outer surface of the cover and that surrounds an open space overlying the lug access path.

3. The circuit breaker of claim 2, wherein the at least one channel comprises a floor with an internal end that is arcuate and that resides in a plane that is adjacent an outer surface of the line side segment of the cover and beneath the internal end portion, with the cover held in a horizontal orientation with the aperture for the switch handle facing upward.

4. The circuit breaker of claim 1, wherein the circuit breaker comprises at least first and second poles, wherein the cover comprises first and second channels as the at least one channel, and wherein the at least one gas-blocking member is provided as a first gas-blocking member and a second gas-blocking member, each comprising a bottom surface that is planar, and wherein the first and second gas-blocking members are independently moveable while coupled to a corresponding first or second channel.

5. The circuit breaker of claim 1, wherein the at least one gas-blocking member is elongate with a perimeter having a pair of long sides spaced across a width dimension, and wherein the at least one gas blocking member has a rigid or semi-rigid three-dimensional body with at least a major portion of a bottom thereof being planar.

6. The circuit breaker of claim 1, wherein the at least one channel has an externally facing top that is open and flush with or recessed with an outer surface of the line side segment, and wherein the at least one channel has a closed floor that is adjacent an outer surface of the cover and that is under the externally facing top, with the aperture for the switch handle facing upward.

7. The circuit breaker of claim 6, wherein the at least one channel has a lateral extent and a longitudinal extent with a laterally and longitudinally extending gap space between opposing sides of a respective channel to define the externally facing top that is open.

8. The circuit breaker of claim 1, wherein, with the circuit breaker oriented with the aperture of the switch handle facing upward, the at least one channel comprises a floor that is closed and that is spaced apart from a floor of a terminal chamber and resides adjacent an outer surface of the cover, and wherein the floor of the at least one channel terminates in a length dimension adjacent but spaced apart from the inner end portion of the at least one channel.

9. The circuit breaker of claim 8, wherein the inner end portion of the at least one channel is arcuate, wherein the floor has an inner end that is arcuate, wherein the floor resides in a plane that is beneath a plane providing the inner end portion of the at least one channel, and wherein the arcuate inner end portion of the at least one channel and the arcuate inner end of the floor face each other and define a circle about the lug access path when viewed from a top with the cover in a horizontal orientation and with the aperture for the switch handle facing upward.

10. The circuit breaker of claim 1, wherein the at least one channel comprises an outer facing end residing at an outer lower perimeter of the cover, with the line side segment of the cover facing down, and wherein the outer facing end is rectangular with a bottom long side thereof residing under or flush with an outer surface of the line side segment of the cover.

11. The circuit breaker of claim 1, wherein the at least one channel comprises laterally spaced apart sidewalls residing, with the circuit breaker oriented with the aperture for the switch handle facing upward, above a rectangular compartment, and above a closed floor of the at least one channel, with the closed floor residing adjacent an outer surface of the cover, and also above lugs coupled to the circuit breaker, and wherein the sidewalls comprise laterally inwardly projecting tabs to thereby facilitate retention of the at least one gas-blocking member in the at least one channel if the circuit breaker is turned upside down.

12. The circuit breaker of claim 1, wherein the at least one gas-blocking member comprises a notch in a leading top end portion thereof configured to engage a screw driver tip to thereby allow a user to dislodge the at least one gas-blocking member for access to the lug access path.

13. A circuit breaker, comprising:

a cover comprising a medial segment with an aperture for a switch handle, wherein the medial segment merges into a line side segment comprising at least one channel, wherein the at least one channel comprises an inner end portion overlying a lug access path; and at least one gas-blocking member coupled to the at least one channel, wherein the at least one gas-blocking member comprises a bottom that is planar, and wherein the gas-blocking member comprises a top portion that extends above the bottom and that comprises a lateral extent over at least major portion of a length thereof that is less than a lateral extent of the bottom.

14. The circuit breaker of claim 13, wherein the top portion has an inner end that is curvilinear, and wherein the bottom has an inner end that resides a distance forward of the inner end of the top portion.

15. A circuit breaker, comprising:

a cover comprising a medial segment with an aperture for a switch handle, wherein the medial segment merges into a line side segment comprising at least one channel, wherein the at least one channel comprises an inner end portion overlying a lug access path; and at least one gas-blocking member coupled to the at least one channel, wherein one of the at least one gas-blocking member is slidably coupled to at least one elongate channel.

16. A circuit breaker, comprising:

a cover comprising a medial segment with an aperture for a switch handle, wherein the medial segment merges into a line side segment comprising at least one channel, wherein the at least one channel comprises an inner end portion overlying a lug access path; and at least one gas-blocking member coupled to the at least one channel, wherein one of the at least one gas-blocking member is pivotably coupled to at least one elongate channel.

17. A circuit breaker, comprising:

a cover comprising a medial segment with an aperture for a switch handle, wherein the medial segment merges into a line side segment comprising at least one channel, wherein the at least one channel comprises an inner end portion overlying a lug access path; and at least one gas-blocking member coupled to the at least one channel, wherein the at least one gas-blocking member has a length dimension that is greater than a width dimension.

18. A cover for a circuit breaker, comprising:

a cover member comprising a medial segment with an aperture for a switch handle, wherein the medial segment merges into a line side segment comprising at least one channel, wherein the at least one channel comprises an inner end portion overlying a lug access path, wherein the at least one channel comprises a closed floor and an externally facing front that is forward of the floor and that is open and flush with or recessed with an outer surface the line side segment, and wherein the floor is adjacent the outer surface of the line side segment of the cover member and extends in the line side segment in a direction that is toward the medial segment.

19. The cover of claim 18, wherein the at least one channel has a rectangular perimeter and is elongate in a direction extending between an outer end of the line side segment toward the medial segment in the line side segment.

20. A method of blocking gas flow in a circuit breaker, comprising:

providing the circuit breaker with a cover comprising at least one channel with a closed surface that is adjacent a front surface of the cover, wherein the closed surface defines an inner wall or ceiling of a terminal compartment and that resides in a line side segment of the cover, the at least one channel comprising an open segment that resides in front of the closed surface and over a lug access path;

moving a gas-blocking member coupled to the at least one channel to a first position to reveal the lug access path while the gas-blocking member remains coupled to the at least one channel, wherein the gas-blocking member is a rigid or semi-rigid member; and moving the gas-blocking member to a second position to occlude the lug access path with the gas-blocking member coupled to the at least one channel to thereby block hot gases generated during a circuit interruption event from traveling outwardly therefrom.

21. The method of claim 20, wherein the at least one channel comprises at least first and second channels, wherein the gas-blocking member is provided as at least first and second separate gas-blocking members, the first gas-blocking member coupled to the first channel and the second gas-blocking member coupled to the second channel, the method further comprising independently moving the first gas-blocking member to the first position while coupled to the first channel and while the second gas-blocking member remains in the second position in the second channel.

22. The method of claim 20, wherein the at least one channel has an externally facing top that is open and flush with or recessed with an outer surface of the line side segment, and wherein the at least one channel also comprises a closed floor that is adjacent the outer surface of the line side segment of the cover under the externally facing top.

23. The method of claim 20, wherein the moving steps are carried out by sliding the gas-blocking member in the at least one channel from an open end thereof toward a switch handle in a medial segment of the cover.

* * * * *